US008517349B1

(12) United States Patent
Ross et al.

(10) Patent No.: US 8,517,349 B1
(45) Date of Patent: Aug. 27, 2013

(54) GUARDRAIL TERMINALS

(75) Inventors: Hayes E. Ross, College Station, TX (US); Roger Bligh, Bryan, TX (US); C. Eugene Buth, Wellborn, TX (US)

(73) Assignee: The Texas A&M University System, College Station, TX (US)

( * ) Notice: Subject to any disclaimer, the term of this patent is extended or adjusted under 35 U.S.C. 154(b) by 1233 days.

(21) Appl. No.: 09/679,902

(22) Filed: Oct. 5, 2000

(51) Int. Cl.
*E01F 15/00* (2006.01)

(52) U.S. Cl.
USPC ..... 256/13.1; 256/1; 404/7

(58) Field of Classification Search
USPC ..... 256/13.1; 404/6, 7, 8, 9; 52/40, 52/726.3, 726.4
See application file for complete search history.

(56) References Cited

U.S. PATENT DOCUMENTS

| | | | | |
|---|---|---|---|---|
| 79,141 | A | 6/1868 | McFarlin | |
| 398,078 | A | 2/1889 | Peterson | |
| 446,852 | A | 2/1891 | Davis | |
| 629,185 | A | 7/1899 | Arnold | |
| 1,329,492 | A | 2/1920 | Babcock | |
| 1,335,302 | A | 3/1920 | Stout | |
| 1,473,118 | A | 11/1923 | Miller-Masury | |
| 1,677,796 | A | 7/1928 | Parks | |
| 2,089,929 | A | 8/1937 | Brickman et al. | |
| 2,091,195 | A | 8/1937 | Dennebaum | |
| 2,123,167 | A | 7/1938 | Cain | |
| 2,135,705 | A | 11/1938 | Florance | |
| 2,146,333 | A | 2/1939 | Deming | 189/36 |
| 2,146,445 | A | 2/1939 | Russert et al. | |
| RE22,060 | E | 4/1942 | Hayden et al. | |

(Continued)

FOREIGN PATENT DOCUMENTS

| | | |
|---|---|---|
| AT | 278890 | 2/1970 |
| AU | 603003 | 3/1989 |

(Continued)

OTHER PUBLICATIONS

Trinity Industries, Inc., Highway Safety Products (ET Family, ET-2000/LET ET-PLUS) Jun. 17, 2000, [online] [retrieved on Feb. 27, 2003] Retrieved from Internet <URL: http://www.highwayguardrail.com/Products%20-%20ET%20FAMILY.html>.*

(Continued)

*Primary Examiner* — Aaron Dunwoody
(74) *Attorney, Agent, or Firm* — Baker Botts L.L.P.

(57) ABSTRACT

Devices and methods for supporting guardrail terminal installations that incorporate safety end treatments such as the GET and the SRT. Preferred embodiments are described wherein guardrail terminal installations are primarily anchored to the ground using weak support posts that are preferably made of metal. The ends of the guardrail installation are secured to the ground using breakaway posts. In operation, the weak posts permit the central portion of the guardrail installation to contain and redirect the vehicle during a lateral collision to the rail member. The anchorage provided by the breakaway end posts helps prevent the guardrail from being excessively displaced, thus preventing the impacting vehicle from breaking through the guardrail. In operation, guardrail terminal assemblies constructed in accordance with the present invention provide an improved support system for the rail member which is more forgiving than conventional strong post anchorages, thereby providing an improvement in safety. At the present time, the invention has particular application in some non-U.S. countries, where it is required or highly preferred that metal support posts be used either completely or primarily within guardrail installations. However, the invention is also applicable to installation within the United States.

13 Claims, 6 Drawing Sheets

(56) References Cited

U.S. PATENT DOCUMENTS 2,309,238 A 1/1943 Corey
2,321,988 A 6/1943 Brickman
2,735,251 A 2/1956 Dlugosch
2,776,116 A 1/1957 Brickman
3,185,445 A 5/1965 Broadway
3,308,584 A 3/1967 Graham
3,332,666 A 7/1967 Gray
3,349,531 A 10/1967 Watson
3,385,564 A 5/1968 Persicke
3,417,965 A 12/1968 Gray
3,450,233 A 6/1969 Massa
3,499,630 A 3/1970 Dashio
3,519,301 A 7/1970 Somnitz
3,521,917 A 7/1970 King
3,567,184 A 3/1971 Yancey
3,606,222 A 9/1971 Howard
3,617,076 A 11/1971 Attwood
3,632,088 A * 1/1972 Filipek et al. ..... 254/89 H
3,637,244 A 1/1972 Strizki
3,643,924 A 2/1972 Fitch
3,680,448 A 8/1972 Ballingall et al.
3,693,940 A 9/1972 Kendall et al.
3,711,881 A 1/1973 Chapman et al.
3,768,781 A 10/1973 Walker et al.
3,776,520 A 12/1973 Charles et al.
3,820,906 A 6/1974 Katt
3,846,030 A 11/1974 Katt
3,856,268 A * 12/1974 Fitch ..... 188/268
3,912,404 A 10/1975 Katt
3,919,380 A 11/1975 Smarook et al.
3,925,929 A 12/1975 Montgomery
3,951,556 A 4/1976 Strizki
3,967,906 A 7/1976 Strizki
3,972,510 A 8/1976 Dougherty
3,981,486 A 9/1976 Baumann
3,982,734 A 9/1976 Walker
4,000,882 A * 1/1977 Penton ..... 256/13.1
4,063,713 A 12/1977 Anolick et al.
4,071,970 A 2/1978 Strizki
4,126,403 A 11/1978 Sweeney et al.
4,183,695 A 1/1980 Wilcox
4,190,275 A 2/1980 Mileti
4,200,310 A 4/1980 Carney, III
4,236,843 A 12/1980 Chisholm
4,269,384 A 5/1981 Saeed et al.
4,278,228 A 7/1981 Rebentisch et al.
4,295,637 A 10/1981 Huleck
4,330,106 A 5/1982 Chisholm
4,351,617 A 9/1982 Landa
4,352,484 A 10/1982 Gertz et al.
4,389,134 A 6/1983 Colas
4,399,980 A 8/1983 van Schie
4,432,172 A 2/1984 Kuykendall et al.
4,452,431 A 6/1984 Stephens et al.
4,490,062 A 12/1984 Chisholm
4,501,411 A 2/1985 Otaki
4,583,716 A 4/1986 Stephens et al.
4,607,824 A 8/1986 Krage et al.
4,645,375 A 2/1987 Carney, III
4,646,489 A 3/1987 Feller et al.
4,655,434 A 4/1987 Bronstad
4,674,911 A 6/1987 Gertz
4,678,166 A 7/1987 Bronstad et al.
4,729,690 A 3/1988 Lavender et al.
4,784,515 A 11/1988 Krage et al.
4,815,565 A 3/1989 Sicking et al.
4,819,915 A 4/1989 Cargnel
4,838,523 A 6/1989 Humble et al.
4,852,847 A 8/1989 Pagel
4,923,319 A 5/1990 Dent
4,926,592 A 5/1990 Nehls
4,928,446 A 5/1990 Alexander, Sr.
4,928,928 A 5/1990 Buth et al.
4,986,687 A 1/1991 Ivey
5,011,326 A 4/1991 Carney, III
5,022,782 A 6/1991 Gertz et al.
5,054,954 A 10/1991 Cobb et al.
5,069,576 A * 12/1991 Pomero ..... 256/13.1
5,078,366 A 1/1992 Sicking et al.
5,112,028 A 5/1992 Laturner
5,203,543 A 4/1993 Fleury
5,214,886 A 6/1993 Hughron
5,244,101 A 9/1993 Palmer et al.
5,248,129 A 9/1993 Gertz
5,286,137 A 2/1994 Cicinnati et al.
5,391,016 A * 2/1995 Ivey et al. ..... 256/13.1
5,403,112 A 4/1995 Carney, III
5,407,298 A 4/1995 Sicking et al.
5,481,835 A 1/1996 Bloom ..... 52/98
5,484,217 A 1/1996 Carroll et al.
5,503,495 A 4/1996 Mak et al.
5,547,309 A 8/1996 Mak et al.
5,647,520 A 7/1997 McDaid
5,657,966 A 8/1997 Cicinnati
5,660,375 A * 8/1997 Freeman ..... 256/13.1
5,660,496 A 8/1997 Muller et al.
5,664,905 A 9/1997 Thompson et al.
5,733,062 A 3/1998 Oberth et al.
5,746,419 A 5/1998 McFadden et al.
5,765,811 A 6/1998 Alberson et al.
5,775,675 A 7/1998 Sicking et al.
5,791,812 A * 8/1998 Ivey ..... 256/13.1
5,797,591 A 8/1998 Krage
5,797,592 A 8/1998 Machado
5,823,584 A 10/1998 Carney, III
5,832,762 A 11/1998 McDaid
5,851,005 A 12/1998 Muller et al.
5,855,443 A 1/1999 Faller et al. ..... 403/2
5,876,020 A * 3/1999 Giavotto ..... 256/13.1
5,924,680 A 7/1999 Sicking et al.
5,931,448 A 8/1999 Sicking et al.
5,957,435 A 9/1999 Bronstad
5,966,867 A 10/1999 Downer et al.
5,988,598 A 11/1999 Sicking et al.
5,992,828 A 11/1999 Burdick
6,007,269 A 12/1999 Marinelli
6,010,275 A * 1/2000 Fitch ..... 256/13.1
6,022,003 A * 2/2000 Sicking et al. ..... 256/13.1
6,065,894 A 5/2000 Wasson et al.
6,092,959 A 7/2000 Leonhardt et al.
6,109,597 A 8/2000 Sicking et al.
6,116,805 A 9/2000 Gertz
6,129,342 A * 10/2000 Bronstad ..... 256/13.1
6,168,346 B1 * 1/2001 Ernsberger ..... 256/13.1
6,203,079 B1 3/2001 Breed
6,210,066 B1 4/2001 Dent
6,220,575 B1 4/2001 Lindsay et al.
6,244,571 B1 6/2001 Reid et al.
6,254,063 B1 7/2001 Rohde et al.
6,260,827 B1 7/2001 Sicking et al.
6,272,796 B1 8/2001 Metzler ..... 52/93.1
6,290,427 B1 * 9/2001 Ochoa ..... 256/13.1
6,299,141 B1 10/2001 Lindsay et al.
6,308,809 B1 10/2001 Reid et al.
6,340,268 B1 1/2002 Alberson et al.
6,347,904 B1 2/2002 Knighton
6,398,192 B1 6/2002 Albritton
6,409,156 B2 6/2002 Dent
6,416,041 B1 7/2002 Sicking et al.
6,435,761 B1 8/2002 Bligh et al.
6,461,076 B1 10/2002 Stephens et al.
6,488,268 B1 12/2002 Albritton
6,554,256 B2 4/2003 Ochoa
6,609,343 B1 8/2003 Litten
6,637,971 B1 10/2003 Carney, III et al.
6,644,888 B2 11/2003 Ochoa ..... 404/6
2001/0013596 A1 8/2001 Sicking et al.
2001/0048101 A1 * 12/2001 Bligh et al. ..... 256/13.1
2002/0007994 A1 1/2002 Reid et al.
2002/0179894 A1 12/2002 Albritton
2003/0015695 A1 1/2003 Alberson et al.
2003/0168650 A1 9/2003 Alberson et al.

| | | | |
|---|---|---|---|
| 2003/0213946 | A1 | 11/2003 | Alberson et al. |
| 2003/0215305 | A1 | 11/2003 | Alberson et al. |
| 2006/0017048 | A1 | 1/2006 | Alberson et al. |

FOREIGN PATENT DOCUMENTS

| | | | |
|---|---|---|---|
| AU | A021844/88 | | 11/1990 |
| CL | 472-00 | | 3/2000 |
| DE | 1 916 361 | | 3/1963 |
| DE | 1534526 | | 11/1965 |
| DE | 3708861 | A1 | 10/1988 |
| EP | 0 245 042 | | 11/1987 |
| EP | 0952256 | A2 | 4/1999 |
| EP | 0 924 347 | A1 | 6/1999 |
| EP | 095226 | A2 | 10/1999 |
| FR | 2 386 667 | | 4/1977 |
| FR | 2386667 | | 3/1978 |
| FR | 2546932 | | 6/1983 |
| GB | 2023695 | A | 1/1980 |
| JP | 10 18255 | | 1/1989 |
| LU | 40465 | | 10/1961 |
| LU | 41444 | | 5/1962 |
| WO | WO 96/20311 | | 4/1996 |
| WO | 98/50637 | | 11/1998 |
| WO | 00/40805 | | 7/2000 |
| WO | 02/18708 | A2 | 3/2002 |

OTHER PUBLICATIONS

Pride Enterprises, (Wood & Recreational Products) Oct. 3, 2000, [online] [retrieved on Feb. 27, 2003] Retrieved from Internet <URL: http://web.archive.org/web/20001003144854/http://www.peol.com/wood.htm>.*

U.S. Appl. No. 09/943,727 entitled: *ET-PLUS: Head Assembly for Guardrail Extruder Terminal*, Aug. 31, 2001.

U.S. Appl. No. 10/308,296 entitled: *Stell Yielding Guardrail Support Post*, Dec. 2, 2002.

ET-2000 the Future of Highway Safety—SYRO (Printed in Dec. 1990; revised Oct. 1992).

Bronstad, et al., *Modified Breakaway Cable Terminals for Guardrails and Median Barriers*, Research Results Digest, NCHRP, Transportation Research Board, Digest 12, May 1978.

*Breakaway Metal Post for Highway Guardrail End Treatments* U.S. Appl. No. 09/074,496, filed May 7, 1998 James R. Albritton, May 7, 1998.

*Breakaway Support Post for Highway Guardrail End Treatments* U.S. Appl. No. 09/358,017, filed Jul. 19, 1999 James R. Albritton, Jul. 19, 1999.

"*INFORMATION: Report 350Acceptance of New York 3-Strand Cable Terminal*", Memorandum No. HMHS-CC63 from Dwight A. Horne, Director, Office Highway Safty Infrastructure, U.S. Department of Transportation, Federal Highway Administration, to Resource Center Directors, Division Administrators and Federal Lands Highway Division Engineers, 2 pages Memorandum and 3 pages of Attachments, Feb. 14, 2000.

"Road Restraint Systems—Part 4: Barrier Systems . . . ", European Standard, Draft, PrEN 1317-4, Jun. 17-18, 1999, European Committee for Standardisation, Doc No: 226/WG1/TG1/041, Contral Secretariat: rue de Stassart 36, B 6 1050 Brussels.

"Road Restraint Systems—Part 4: Performance Classes . . . ", British Standard, Oct. 18, 2002, © BSI, ENV 1317-4:2001 (E).

"Recommended Procedures for the Safety Performance Evaluation of Highway Features", NCHRP Report 350, National Cooperative Highway Research Program, Transportation Research Board.

"BEAT Box Beam Bursting Energy Absorbing Terminal", RSI Road Systems, Inc., http://www.roadsystems.com/beat.htm.

* cited by examiner

GUARDRAIL TERMINALS

BACKGROUND

1. Field of the Invention

The present invention generally relates to improvements for guardrail terminal installations and, in particular aspects, the invention relates to improved support posts and support systems for guardrail terminal systems that have safety end treatments.

2. Description of the Related Art

An important aspect of guardrail design is the ability of the guardrail to resist rupture and prevent penetration of the rail by a vehicle that impacts the guardrail end. For that reason, conventional guardrail installations are provided along their lengths with "strong" support posts that provide very little give when impacted by a vehicle. "Strong" support posts include 7" diameter wood posts, W6×9 steel section posts and 6" by 8" wood posts.

Recently, it has also become important that a guardrail installation not present a hazard to a vehicle during an "end-on" impact where the guardrail installation is impacted from its end by a vehicle. As a result, a number of solutions have been proposed and used for eliminating the upraised end of the guardrail for making it safer.

The guardrail extruder terminal (GET) and slotted rail terminal (SRT) are known safety end treatments for a guardrail assembly that permit the guardrail assembly to safely absorb some or all of the vehicle's kinetic energy during an end-on collision, thereby eliminating the hazard associated with the upraised end. These end treatments are desirable because they absorb the energy of an end-on collision in a controlled manner to help bring an impacting vehicle to a safe stop or they allow the vehicle to safely "gate" through the terminal after absorbing some of the vehicle's energy. The GET is described in U.S. Pat. Nos. 5,078,366 and 4,928,928. The SRT is described in U.S. Pat. Nos. 5,547,309 and 5,407,298. Those patents are incorporated herein by reference. These end treatments were originally designed so that the support posts of the terminal would be readily frangible, "breakaway" posts made of wood. Holes were usually drilled through the post near the ground line in order to weaken the post at that point. Guardrail support posts downstream from the terminal are typically solid wooden posts used to securely anchor the midportion of the guardrail assembly to the ground. As the guardrail collapsed or became flattened by the end treatment, the breakaway posts would be broken at or around the ground line.

There are, however, drawbacks to using strong posts along the length of the end-treatment terminal. The strong posts must be weakened in some manner to accommodate end on impacts to the terminal. These modifications are costly and time consuming and, if done improperly or forgotten, can result in a significant safety hazard for motorists.

The inventors believe that, to date, guardrail terminals have used entirely strong support posts that have been modified by drilling holes or using other means to cause the post to breakaway. An improved guardrail installation would be desirable.

SUMMARY OF THE INVENTION

The present invention provides new and innovative devices and methods for supporting guardrail in guardrail terminals that incorporate safety end treatments such as the GET and the SRT. Preferred embodiments are described wherein the guardrail in a terminal is primarily supported above the ground using weak support posts that are preferably made of metal. The ends of the terminal installation are secured to the ground using breakaway posts and other accessories.

In operation, the weak posts in the downstream portion of the guardrail installation help to contain and redirect a vehicle during a lateral collision to the rail member. The anchorage in part provided by the breakaway end posts helps prevent excessive guardrail displacements that will allow the impacting vehicle to pass over to the opposite side of the guardrail during side or lateral impacts along the length of the terminal.

In other aspects, the invention provides an alternative to use of post weakening mechanisms which results in savings of costs. In operation, terminal assemblies constructed in accordance with the present invention provide an improved support system for the rail member which is more forgiving than conventional strong post support systems, thereby providing an improvement in safety.

At the present time, the invention has particular application in some non-U.S. countries, where it is required or highly preferred that metal support posts be used either completely or primarily within guardrail installations. However, the invention is also applicable to installation within the United States.

DETAILED DESCRIPTION OF THE PREFERRED EMBODIMENTS

Figure 1:
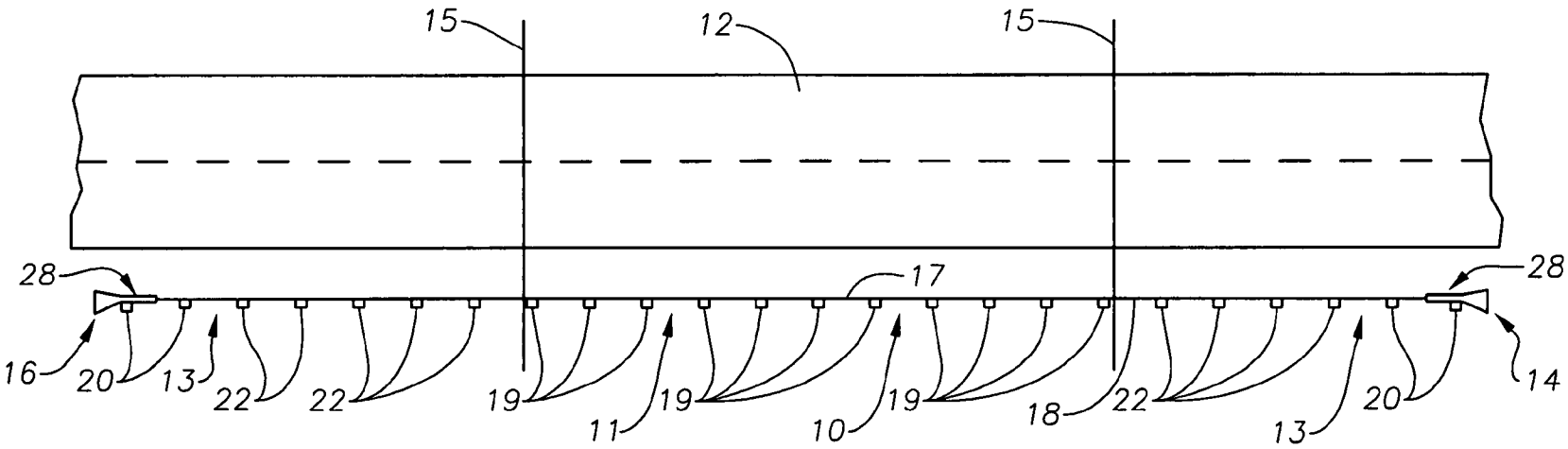
FIG. 1 is an overall plan view of an exemplary guardrail system constructed in accordance with the present invention having a guardrail extruder terminal-type end treatment.
Figure 2:
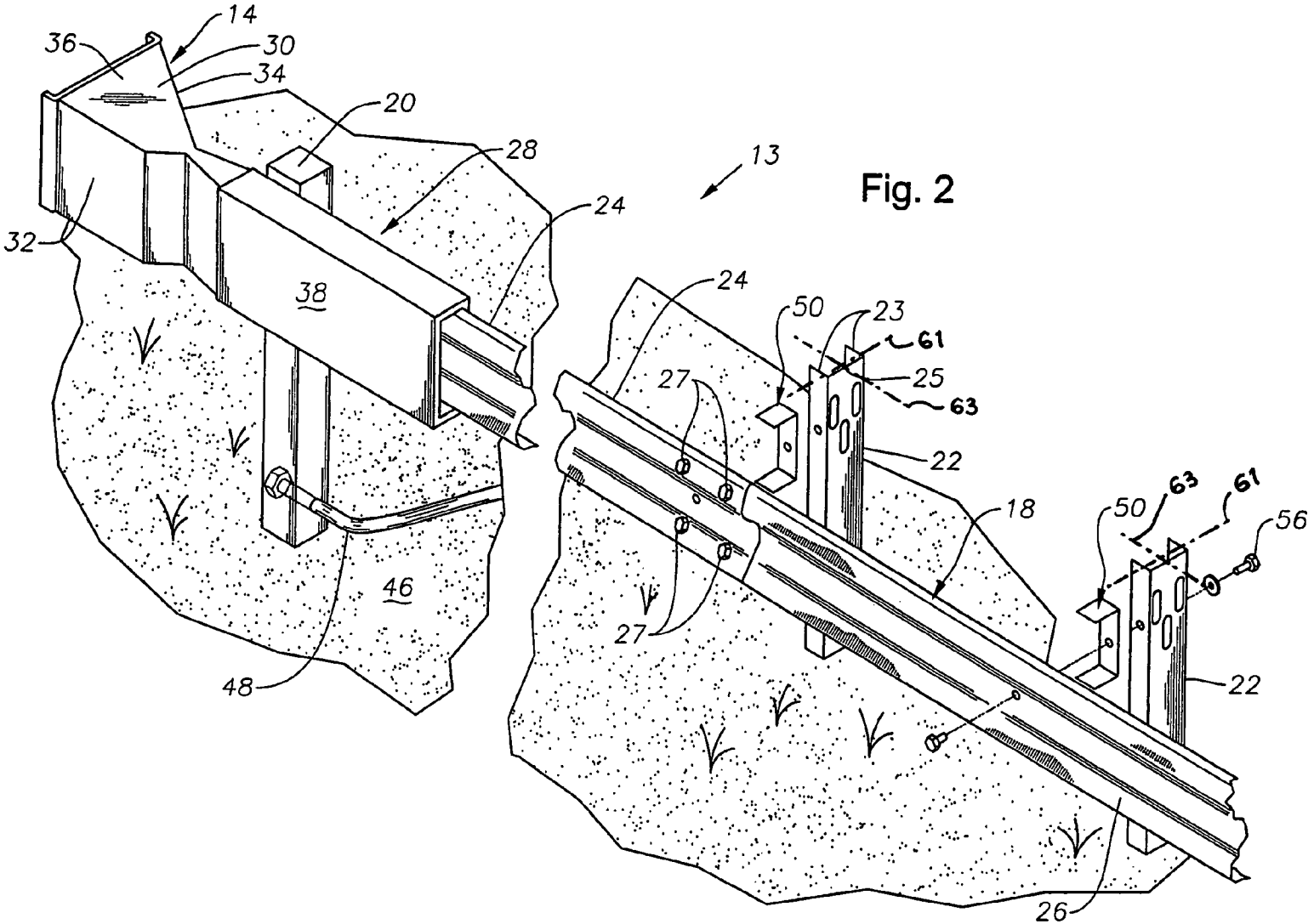
FIG. 2 is a perspective view of the upstream end of the exemplary guardrail system illustrated in FIG. 1.

Referring initially to FIGS. 1 and 2, there is shown an exemplary guardrail assembly 10 that is constructed in accordance with the present invention. The guardrail assembly 10 runs longitudinally along a section of roadway 12 and has a first, upstream end 14 and a second, downstream end 16. Although the guardrail installation 10 is depicted as being disposed along a straight line, it will be understood that it may be curved as well to conform to the shape of the roadway 12 and may be made of any desired length. The guardrail installation 10 has a central standard guardrail section 11 with guardrail safety end terminals 13 located on either end of the standard section 11. The boundaries between the terminals 13 and the standard guardrail section 11 are illustrated by lines 15 in FIG. 1. The standard section 11 includes a corrugated rail 17 that is supported, in most instances, by strong posts 19.

Each of the guardrail terminals 13 include a substantially continuous, corrugated rail 18 that is supported at its end 14 or 16 by a pair of support posts 20. The rail 18 is supported in each terminal 13 by support posts 22.

FIG. 2 depicts the upstream end 14 of one of the guardrail terminals 13 in greater detail. It is noted that the construction and operation described for the upstream end 14 is representative of both the upstream and downstream ends 14, 16. FIG. 2 illustrates that the rail 18 is made up of corrugated rail members 24, 26 that are interconnected, or spliced, to one another using nut and bolt assemblies 27.

Figure 4:
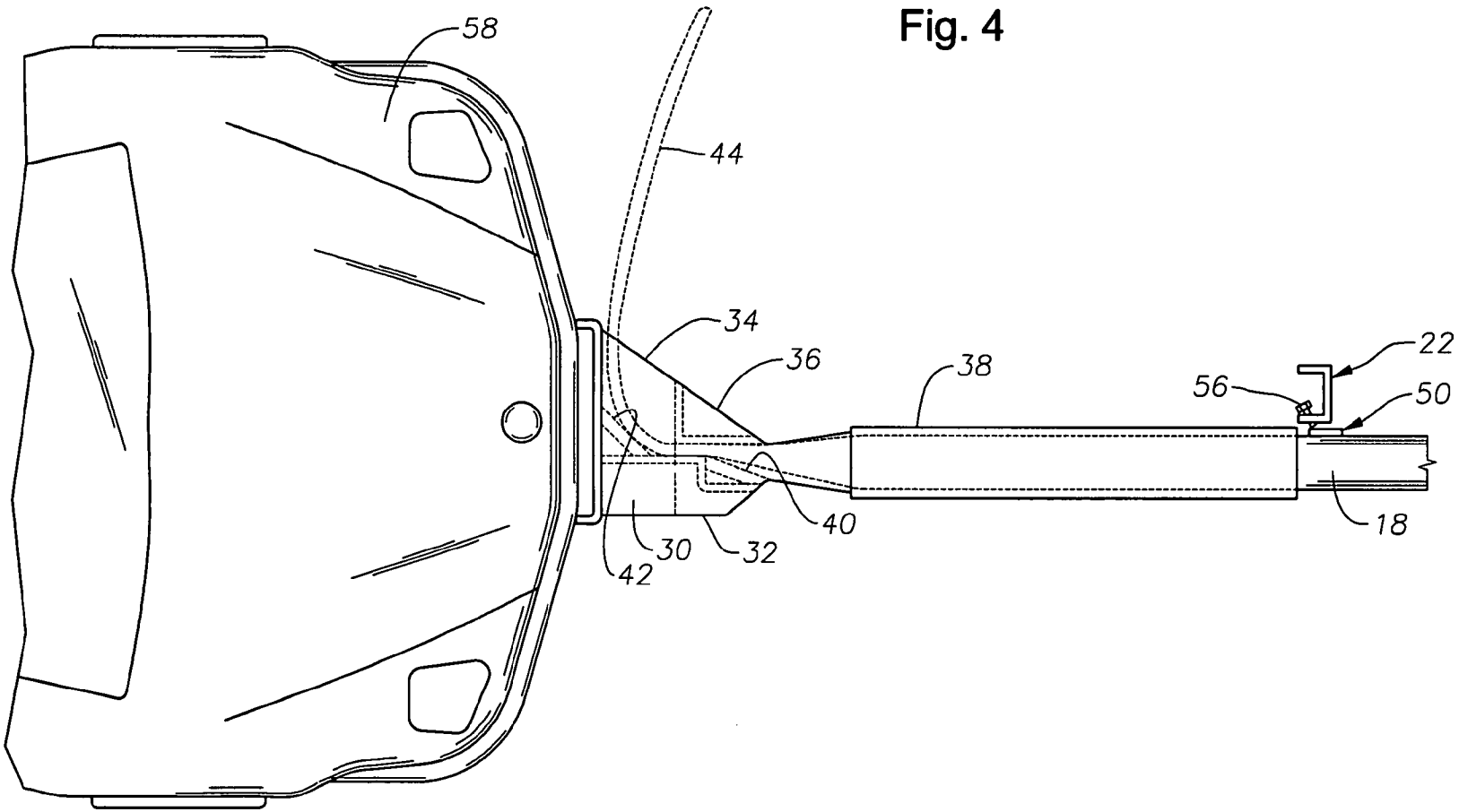
FIG. 4 is a plan view illustrating disconnection of a weak support post from the rail member during an end-on collision.

Each terminal 13 of the rail installation 10 includes a safety device, generally depicted at 28 in FIG. 2 which is used to reduce the hazard associated with an upraised guardrail end. In this embodiment, the safety device 28 provides a guardrail extruder terminal impact head 30. The structure and operation of these type of terminal heads 30 is generally described in U.S. Pat. Nos. 5,078,366 and 4,928,928. FIGS. 2 and 4 illustrate the fact that the traffic side 32 of the head 30 has reduced profile as compared to the non-traffic side 34 of the head 30. The head 30 is composed of an impact portion 36 and a feeder chute 38 that fits over the end of the rail 18. As FIG. 4 shows, the head 30 encloses a throat 40 that receives the rail 18 and helps flatten the corrugations in the rail 18. Additionally, the head 30 includes a curved bending plate 42 that bends and further flattens the rail portion 18, displacing it laterally away from the head 30. FIG. 4 illustrates a flattened portion 44 of the rail 18 being displaced laterally away from the head 30.

Preferably, up to three types of support posts, 20, 22, and 19 may be used to support the rails 17 and 18. Moving downstream from the impact head 30 along the terminal 13, the first two support posts 20 (only one shown in FIG. 2) are breakaway post members that provide secure anchorage of the rail 18 to the ground 46. The anchorage provided by the support posts 20 is required for redirection of vehicles that might impact the rail assembly 10 from the side proximate the end 14.

A tension cable assembly 48 (shown in FIG. 2) is disposed through the lead breakaway post 20. Tension cable assemblies such as assembly 48 are well known in the art and operate to transmit tensile forces applied longitudinally to the rail 18 to the lower end of the lead support post 20. As a result, the force from lateral impacts to the rail 18 are, in part, transmitted to the lower end of the support posts 20 at either end 14, 16 of the installation 10. This helps to securely anchor the rail 18 during such lateral impacts.

The support posts 20, which are the one or two most extreme posts at either end 14 or 16 of the installation are, as noted, frangible or breakaway in nature. During an end-on impact, then, the supports posts 20 will easily breakaway near the ground line of the post 20 to release the cable 48 and the rail 18 from their anchorage. With when the lead post broken away, the cable assembly 48 will also be released from its attachment to the post 20. There are a number of post structures that are suitable for use as breakaway posts 20. In certain, non-U.S. countries, for example, it is desirable and sometimes required to use non-wooden posts for guardrail installations. Thus, a breakaway steel post assembly would be particularly desirable. One example of a suitable steel breakaway post is described in U.S. Pat. No. 5,988,598. Another suitable steel breakaway post is the HBA post, which is Marketed commercially by Trinity Industries of Dallas, Tex. In other instances, a wooden breakaway post may be used, although this is not preferred, particularly in many non-U.S. countries where the use of wooden support posts must be minimized or eliminated. The structure and operation of wooden breakaway posts is known and described in U.S. Pat. No. 5,547,309.

Posts 22 located along the length of each terminal 13 downstream from posts 20 along assembly 10, are unmodified yielding, or "weak," support posts. The term "unmodified," as used herein, refers to a post that has not been subjected to any weakening mechanisms, whether by mechanical, chemical or other means, such as by drilling holes in the post, by notching the post, by incorporating mechanical breakaway devices such as frangible connections, or by incorporating bolts that shear upon impact. The unmodified weak post, by its inherent cross-sectional properties and material properties, readily yields or is deflected in a collision. It is preferred that the weak posts 22 be formed of metal rather than of wood. An unmodified "weak" support post is a support post that readily yields or is deflected in a collision. Further, an unmodified weak support post is one that will meet "preferred" occupant impact velocity and occupant ridedown acceleration limits, as recommended in NCHRP Report 350 or its successor, when impacted in a direction consistent with the direction it would be impacted in end-on tests of a guardrail terminal by design vehicles recommended in NCHRP Report 350 or its successor, traveling at speeds of approximately 15 mph or greater with the post embedded in soils as recommended in NCHRP Report 350 or its successor. Weak support posts are further characterized by a greater amount of deflection upon impact than strong posts.

In addition, an unmodified weak guardrail post is one that will meet Impact Severity Class A, as specified in CEN prEN 1317-4, Trento, June 1999, or its successor, when impacted in end-on tests of a guardrail terminal by test vehicles specified in CEN prEN 1317-4, Trento, June 1999, or its successor, traveling at speeds or approximately 25 km/h or greater, with the posts embedded in soils as recommended in CEN prEN 1317-4, Trento, June 1999, or its successor.

Figure 3:
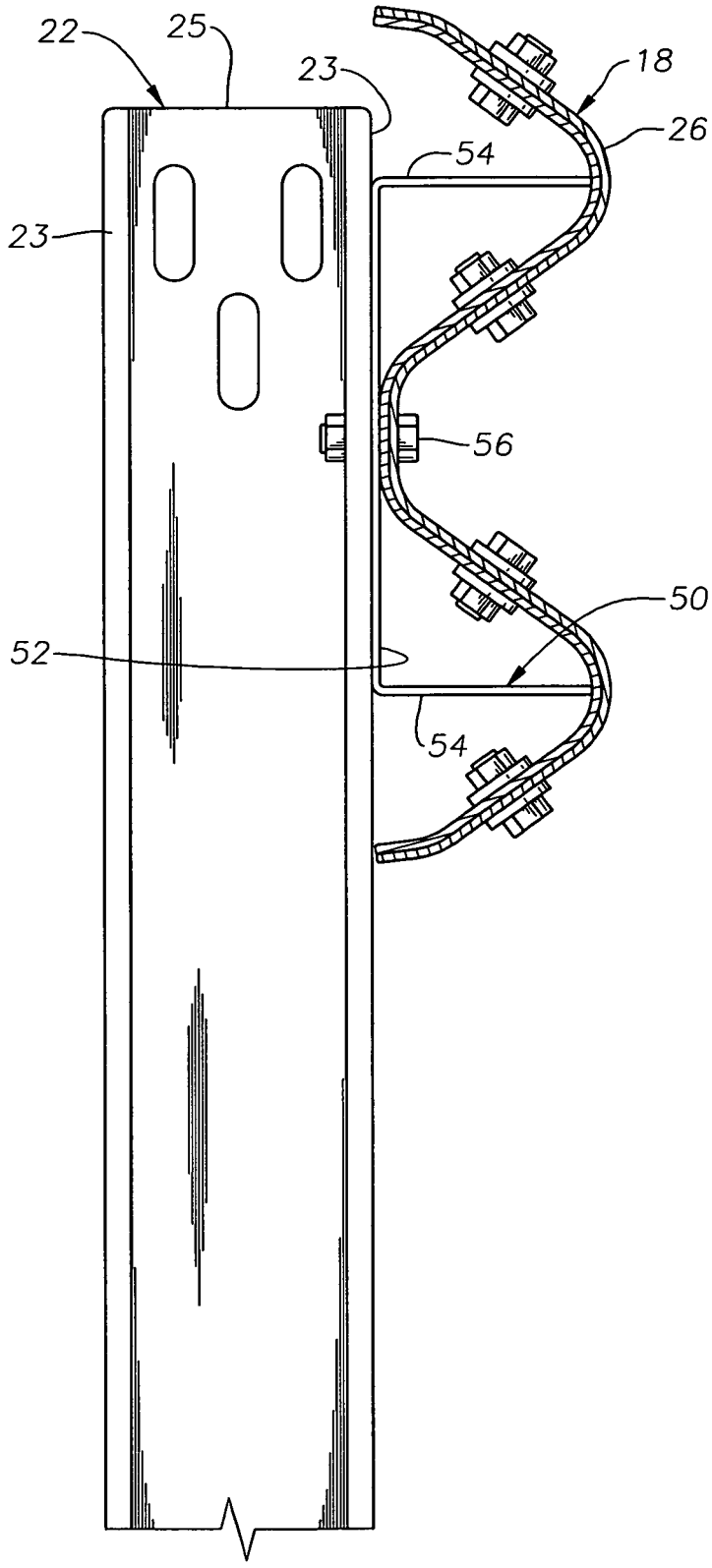
FIG. 3 is a cutaway detail illustrating interconnection of the rail member to a support post.

Examples of commercially available unmodified weak posts are 4" diameter circular wood posts, 4"×6" rectangular wood posts and S3×5.7 steel section posts. It is preferred, particularly for application in many non-U.S. countries, that the weak posts comprise either C-120 or S3×5.7 steel section posts since these posts are not made of wood. Presently, it is highly preferred that the weak posts 22 comprise a C-120-type post, which is a standard Spanish support post. A U-shaped post is illustrated in FIGS. 2, 3 and 4. It can be seen that the U-shaped post has a U-shaped cross-section. This U-shape has a weak axis 61 running parallel to the cross-member 25 of the post 22, and a strong axis 63 running parallel to the two legs 23 of the post 22. The U-shaped post is, therefore, more easily bent around the weak axis 61 than around the strong axis 63. As a result, the U-shaped post has the advantageous property of yielding more easily in response to an end-on impact than to a lateral impact upon the rail 18.

Figure 5:
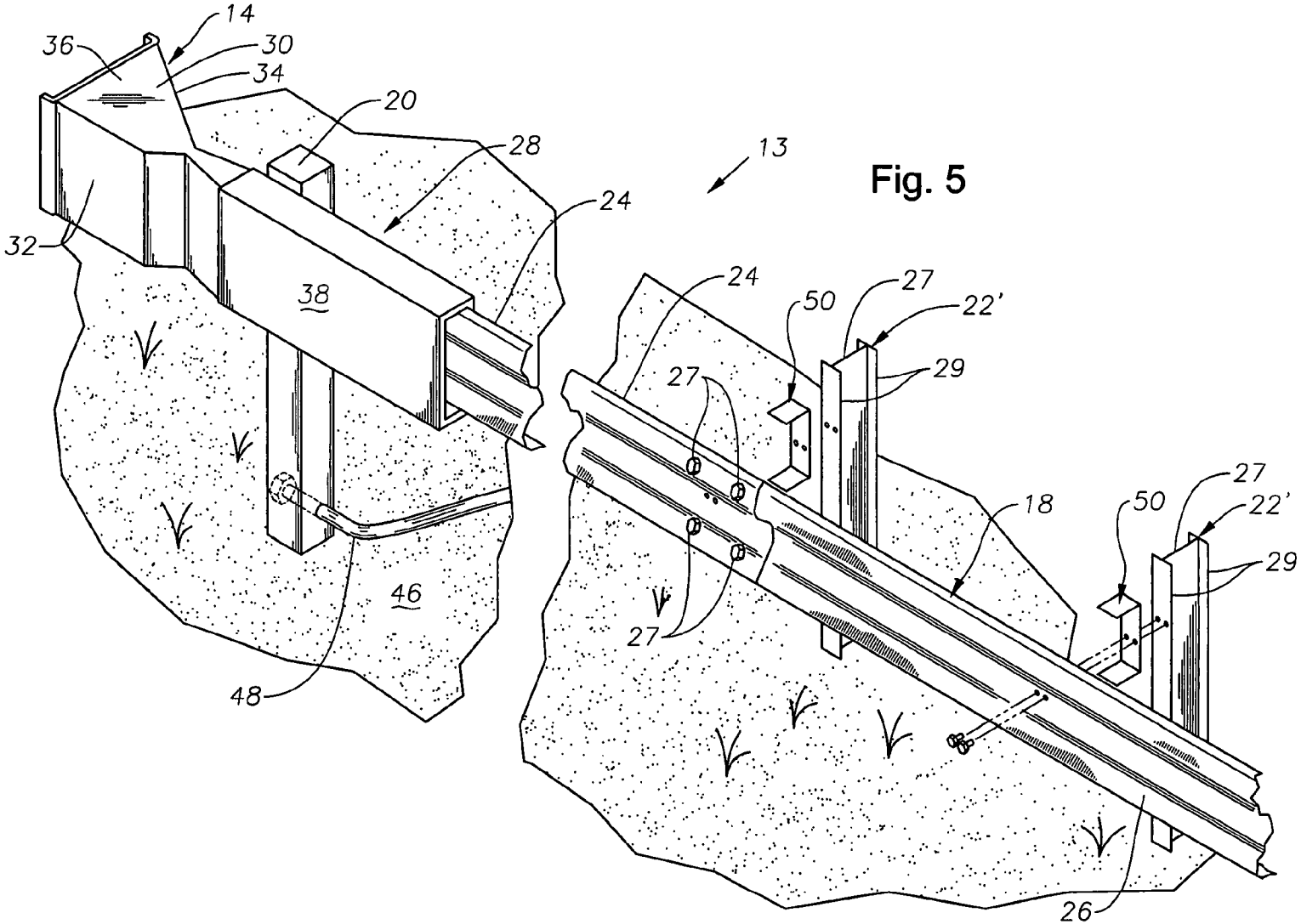
FIG. 5 illustrates an exemplary S3×5.7 steel section post supporting a rail.

FIG. 5 illustrates an embodiment of the invention wherein the rail 18 is being supported by unmodified posts 22' that comprise S 3×5.7 steel section post members. The S 3×5.7 steel section post has an H-shaped cross-section made up of a central web 27 and two end flanges 29. Two connectors 31 are used to affix the rail 18 and bracket 50 to one of the end flanges 29. As can be seen, the S 3×5.7 post provides the same sort of weak and strong axes as the C-120 post member, and it will also provide the advantage of more readily yielding in response to an end-on collision than a lateral impact to the rail 18.

Posts 19 located along the central portion of the guardrail installation may be the same as posts 22 or 22', or they may be different in size, shape or material.

FIGS. 2 and 3 illustrate the details of attachment of the rail 18 to U-shaped post 22. A U-shaped standoff bracket 50 is disposed between the rail 18 and each post 22. The U-shaped bracket 50 has a central web 52 and two legs 54, as FIG. 3 shows. The bracket 50 is located so that the rail 18 is engaged by portions of the web 52 and each leg 54. A connector 56, such as a nut-and-bolt assembly, is disposed through the post 22, bracket 50 and rail 18 to securely affix the rail to the post 22. The legs 54 of the bracket 50 provide stiffness to the rail 18 and help to distribute the force of a lateral impact upon different areas of the support post 22. In testing, the presence of the bracket 50 has been shown to reduce the amount of deflection of the rail 18 in response to a lateral impact. Therefore, the brackets 50 compensate somewhat for the weakness of the weak support posts 22 and help ensure that a laterally impacting vehicle will not rupture or penetrate the rail 18. In a preferred embodiment of the invention, the support posts 22 that are located 3rd, 5th and 7th from each end 14, 16 of the rail assembly 10 are not affixed to the rail 18 with connectors. This makes it easier for the rail 18 to feed properly into the impact head 30 since the rail is typically spliced together at these posts. An example of a splice in the rail 18 is shown in FIG. 2 where rail members 24 and 26 are joined by connectors 27.

FIG. 4 depicts the release of the rail 18 from a weak support post 22 during an end-on impact. As shown there, the impact head 30 has received an end-on impact from vehicle 58 that has driven the head 30 down along the rail 18 thereby flattening and displacing the rail 18 to provide flattened portion 44. In the position shown, the head 30 has traveled downstream past the locations of the two breakaway posts 20. The feeder chute 38 of the head 30 has contacted the bracket 50 and the connector 56 passing through the bracket 50 that interconnects the rail 18 to the post 22. The feeder chute 38 has released the connection. Typically, the connection is released as the connector 56 is pulled through the rail 18. It is noted that the bracket 50 provides a surface upon which the downstream end of the feeder chute 38 is contacted during the downstream movement of the head 30. The weak support post 22 will later be bent down from the rail 18 by the impact portion 36 and vehicle 58. The unmodified weak post 22 typically yields by bending proximate the point at which it is buried in the ground. This bending down is very advantageous as it permits support posts to be readily bent down permitting the impacting vehicle 58 to easily traverse the post in the collision.

Figure 6:
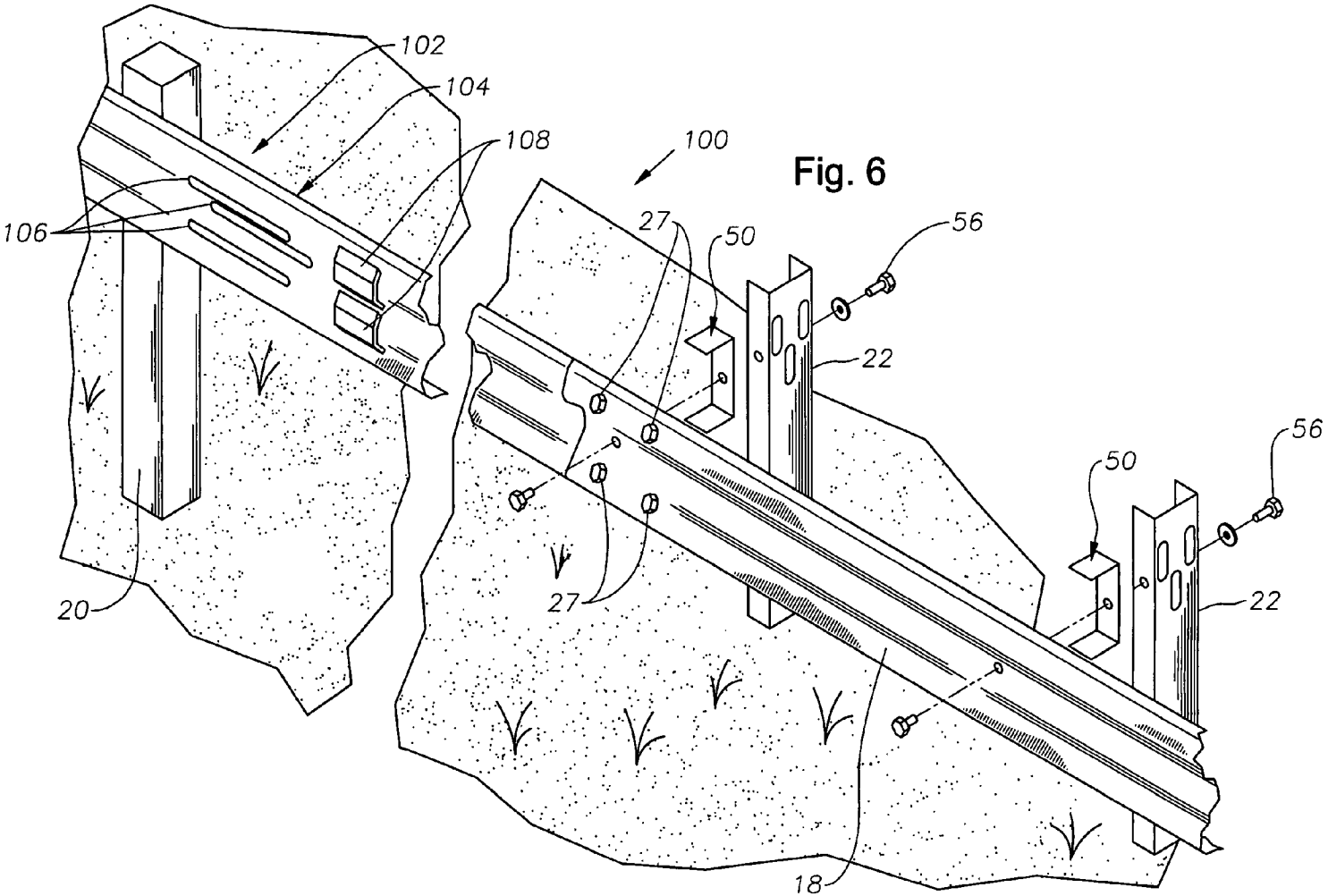
FIG. 6 depicts an alternative guardrail installation constructed in accordance with the present invention and having a slotted rail terminal-type end treatment.

Referring now to FIG. 6, a second embodiment of the invention is described. Like components between the two embodiments are numbered alike. Guardrail installation 100 includes a rail-collapsing slotted rail terminal (SRT)-type end treatment 102 at its upstream end 14. The construction and operation of SRT end treatments is, as noted previously, described in U.S. Pat. Nos. 5,547,309 and 5,407,298. The SRT end treatment 102 features several slotted sections 104 (only one shown) in the rail 18. The slotted section 102 contains three longitudinal slots 106 that are cut into the rail 18 to weaken its ability to structurally withstand an end-on impact. Slot guards 108 are located at the downstream end of the slots 106.

The guardrail installation 100 should, in response to a lateral impact upon the rail 18, react in the same manner as the installation 10 described earlier. The weak posts 22 will yield or be deflected thereby softening the impact for the impacting vehicle. In an end-on impact, the SRT end treatment 102 will result in axial collapse of the rail 18. The rail 18 will be released from the weak support posts 22 as the connectors 56 are pulled out of the rail 18.

A principal advantage is that guardrail installations constructed in accordance with the present invention are more forgiving during an impact to the lateral side thereby resulting in less damage to impacting vehicles and their passengers. Strong wooden support posts used in conventional systems do not easily yield in a collision and thus cause significant damage to the impacting vehicle. At the same time, the weak posts 20 used in the invention are capable of arresting an impacting vehicle that would impact the lateral side of the rail 18. This capability is provided, in part, by the brackets 50 and the anchorage afforded the system by the tension cable assembly 48. A further considerable advantage provided by the present invention is the savings in cost over installations that utilize more expensive strong wooden posts.

While the invention has been shown or described in only some of its forms, it should be apparent to those skilled in the art that it is not so limited, but is susceptible to other various changes without departing from the scope of the invention.

What is claimed is:

1. A system for supporting a guardrail terminal having a safety end treatment, comprising: an upstream end of a rail member associated with the safety end treatment; a breakaway support post configured to support the upstream end; and an unmodified weak support post downstream from the breakaway support post, the unmodified weak support post having an upper portion configured to couple to a portion of the rail member adjacent the upstream end and a lower portion adapted to embed into the earth, the unmodified weak support post configured to bend proximate a point at which the unmodified weak support post embeds the earth without being subject to any weakening mechanisms; and wherein the unmodified weak support post comprises: a first dimension measured in a direction that is parallel to the rail member; and a second dimension measured in a direction that is perpendicular to the rail member, and wherein the first dimension is less than the second dimension to provide the unmodified weak support post with a weak axis running perpendicular to the portion of the rail member and strong axis running parallel to the portion of the rail member, wherein the unmodified weak support post is selected from the group consisting of a C 120 metal post and S3×5.7 steel section post.

2. The system of claim 1, further comprising one or more connectors adapted to couple the upper portion of the unmodified weak support post to the portion of the rail member.

3. The system of claim 2, further comprising a bracket disposed between the unmodified weak support post and the portion of the rail member.

4. The system of claim 1, wherein the safety end treatment comprises a guardrail extruder terminal.

5. The system of claim 4, wherein the guardrail extruder terminal comprises an impact head having a reduced traffic side profile.

6. The system of claim 1, wherein the safety end treatment comprises a slotted rail terminal.

7. A guardrail terminal, comprising: a portion of a rail member having an upstream end; a safety end treatment coupled to the upstream end; a breakaway support post supporting the upstream end; and an unmodified weak support post supporting the portion of the rail member adjacent the upstream end, the unmodified weak support post having a first dimension measured in a direction that is parallel to the rail member and a second dimension measured in a direction that is perpendicular to the rail member, the unmodified weak support post configured to bend about the weak axis proximate a point at which the unmodified weak support post embeds in the earth without being subject to any weakening mechanisms; and wherein the first dimension is less than the second dimension to provide the unmodified weak support post with a weak axis running perpendicular to the portion of the rail member and strong axis running parallel to the portion of the rail member, wherein the unmodified weak support post is selected from the group consisting of a C 120 metal post and S3×5.7 steel section post.

8. The guardrail terminal of claim 7, wherein the breakaway support post is formed of metal.

9. The guardrail terminal of claim 7, wherein the safety end treatment comprises a guardrail extruder terminal.

10. The guardrail terminal of claim 7, wherein the safety end treatment comprises a slotted rail terminal.

11. A guardrail assembly, comprising: a central section disposed between two end terminal sections, each end terminal section comprising: a portion of a rail member; a safety end treatment coupled to a first end of the portion of the rail member; a breakaway support post supporting the first end; and an unmodified weak support post supporting a second end of the portion of the rail member adjacent the first end, the unmodified weak support post configured to bend proximate a point at which the unmodified weak support post embeds the earth without being subject to any weakening mechanisms; and wherein the unmodified weak support post comprises: a first dimension measured in a direction that is parallel to the rail member; and a second dimension measured in a direction that is perpendicular to the rail member, and wherein the first dimension is less than the second dimension to provide the unmodified weak support post with a weak axis running perpendicular to the portion of the rail member and strong axis running parallel to the portion of the rail member, wherein the unmodified weak support post is selected from the group consisting of a C 120 metal post and S3×5.7 steel section post.

12. The assembly of claim 11, wherein the safety end treatment is selected from the group consisting of a guardrail extruder terminal and a slotted rail terminal.

13. A system for supporting a guardrail terminal having a safety end treatment, comprising: an upstream end of a rail member associated with the safety end treatment; a breakaway support post supporting the upstream end; and an unmodified weak support post downstream from the breakaway support post, the unmodified weak support post comprising: a first dimension measured in a direction that is parallel to the rail member; a second dimension measured in a direction that is perpendicular to the rail member; an upper portion configured to couple to a portion of the rail member adjacent the upstream end; and a lower portion adapted to embed into the earth, the lower portion configured to bend proximate a point at which it embeds in the earth without being subjected to any weakening mechanisms; and wherein the first dimension is less than the second dimension to provide the unmodified weak support post with a weak axis running perpendicular to the portion of the rail member and strong axis running parallel to the portion of the rail member, wherein the unmodified weak support post is selected from the group consisting of a C 120 metal post and S3×5.7 steel section post.

* * * * *